United States Patent [19]

Zimmermann et al.

[11] 4,281,465

[45] Aug. 4, 1981

[54] METHOD AND APPARATUS FOR THE RECOVERING OF SOLVENTS IN DRY CLEANING UNITS

[75] Inventors: Martin R. Zimmermann, Bremen, Fed. Rep. of Germany; Walter Oettli, Walchwil, Switzerland

[73] Assignee: AMEG Verfahrens-und Umweltschutz-Technik AG, Cham, Switzerland

[21] Appl. No.: 842,298

[22] Filed: Jul. 17, 1978

[51] Int. Cl.[3] ..... F26B 3/04

[52] U.S. Cl. ..... 34/26; 34/28; 34/54; 34/77; 34/80; 68/18 C

[58] Field of Search ..... 34/72, 77, 26, 28, 54, 34/80, 32; 68/18 C, 18 F, 18 R

[56] References Cited

U.S. PATENT DOCUMENTS

| | | | |
|---|---|---|---|
| 2,189,915 | 2/1940 | Mellor et al. | 34/77 |
| 4,087,923 | 5/1978 | Wilt, Jr. et al. | 34/72 |
| 4,154,002 | 5/1979 | Moore | 34/77 |

*Primary Examiner*—Larry I. Schwartz

*Attorney, Agent, or Firm*—Charles Hieken

[57] ABSTRACT

In a process for recovering solvents from the circulating air and exhaust air of a drycleaning machine by drying the circulating air and by fresh air drying with condensation and adsorption, the volume of air stream per unit volume is controlled in accordance with temperature and/or solvent concentration and heating and cooling energy reduced to achieve drying and recovery of the cleaning solvent with relatively low expenditure of energy and time.

17 Claims, 4 Drawing Figures

METHOD AND APPARATUS FOR THE RECOVERING OF SOLVENTS IN DRY CLEANING UNITS

BACKGROUND OF THE INVENTION

1. State of Art

In dry cleaning processes it is very important to separate solvents which are retained after the cleaning and centrifuging within the textiles in order to avoid pollution of the air when taking out the clothing from the machine and in order to recover the solvents. For this purpose it is known to add a drying process by drying the circulating air and following drying by fresh air. For drying the circulating air the air in the machine is circulated by a blower drawing the air from the textiles via a lint trap and pressing the air through a condenser and heating device back to the drum or basket of the machine. After a drying interval of about 10 to 20 minutes the drying process of the circulating air is followed by a drying process by fresh air which is drawn via the cleaning chamber and condenser towards a discharge or exhaust duct including an adsorber for separation of remaining solvents. Hitherto such drying process has been performed with full blower power. This is disadvantageous on account of the fact that for a time unnecessary much air is driven through the textiles, the condenser and heater and that the cooperation between recovery by condensation and adsorption is unsatisfactory. The problem is to transport during drying the circulating air by heating as much solvents as possible in a period as small as possible from the textiles towards the condenser for separating by condensation and to deodorize during drying by fresh air said textiles so that it is possible to take out the textiles essentially inodorous. The maximum output of the blower, however, is necessary only at the beginning and at the end of the drying process. Therefore, if the output of the blower is not diminished during the drying process unnecessary high energy is consumed for heating of the circulating air before its entrance into the textiles and much cooling water is consumed unecessarily for cooling the air leaving the textiles.

It has already been proposed to improve the recovery of solvents by the insertion of a water chamber within the air duct to the adsorber. However, such a water chamber generally represents a constant flow resistance and therefore is not suitable to adapt the volume of air flow to the rapidly changing concentration of solvent vapours. Furthermore, such water chamber has the disadvantage that little drops of water are drawn by the stream of air towards the adsorber and thus will diminish the effectiveness of the adsorbent material. Besides this, the separation of residuals of solvents by fresh air during the fresh air drying period is handicaped and the expenditure of time is highly increased without any benefit.

2. Problem

The main problem of the present invention is to provide a method and apparatus as outlined above which may guarantee an optimal drying and recovery process with low expenditure of energy and time.

SOLUTION OF THE PROBLEM

In achieving this aim, the invention starts from the principle that the drying and recovery process is running under rapidly changing conditions and that it therefore is necessary for optimal performance to adapt said factors very sensitively during the drying process. This can be reached according to the present invention in a very simple manner by that the volume of air stream per unit time interval (hereafter "air volume") is changed dependent on the condition values determining the effect of recovery by condensation and adsorption. Thereby it is possible to control the dwell periods of the mixture of air and solvent vapours within the textiles as well as within the condenser and adsorber and heater in such a manner that optimal proportions of influences are obtained for the recovery process.

In order to ensure a rapid and satisfying separation of solvents during circulating drying with low expenditure of energy it is advantageous to have a decreasing air volume during this drying process, for instance, by diminishing the air volume after heating to 1/10 of the initial air volume which then will be active at the beginning of the exhaust period through the adsorber. During the second drying period, the exhaust air drying period, the air volume preferably is increased beginning with a low value.

When heating the circulating air before entrance into the cleaning chamber with the textiles in it it is possible to reduce the heating energy so that a constant temperature of the circulating air is reached in spite of decreasing air volume. Also the volume of cooling water for the condenser may be controlled in such a manner that a given output temperature of the condenser is maintained.

After the beginning of the exhaust period the air volume is preferably controlled in such a manner that the fresh air will be heated up to approximately 60° C. within the yet warm textiles. The air volume may be controlled dependent on measured values of physical conditions influencing the separation of solvents, as for instance, concentration and/or temperature. Preferably the air volume is controlled automatically. Furthermore it is possible mostly to control the change of air volume by a timer which in some cases may be adjustable subject to changing conditions like room temperature and character as well as volume of the textiles. Known means may be used for change of air volume. Preferably such means consists of means for choking or throttling the stream of air within the circulating way or exhaust way.

Also without any change of the chemical dry cleaning apparatus itself it may be possible to obtain an essential improvement of the efficiency of separation of solvents by condensation in the condenser of the dry cleaning apparatus and following adsorption within the adsorber, merely by changing the air volume during the exhaust period of the drying and separation process. In such a case means for controlling the air volume are necessary only in the exhaust pipe, for instance, by providing the air inlet of the adsorber with means for throttling the air stream. In such a case it is advantageous to provide the adsorber with two separate air inlets, namely a first inlet which is provided with means for throttling the air stream and a second inlet for fresh air which is used for regeneration of the adsorbent. By a good dosage of air volume during the exhaust period it is possible to reach optimal conditions during the separation by condensation within the condenser of the cleaning machine as well as during adsorption in the connected adsorber and that in connection with small expenditure of energy and simple and compact technical means.

DESCRIPTION OF EMBODIMENTS

Figure 1:
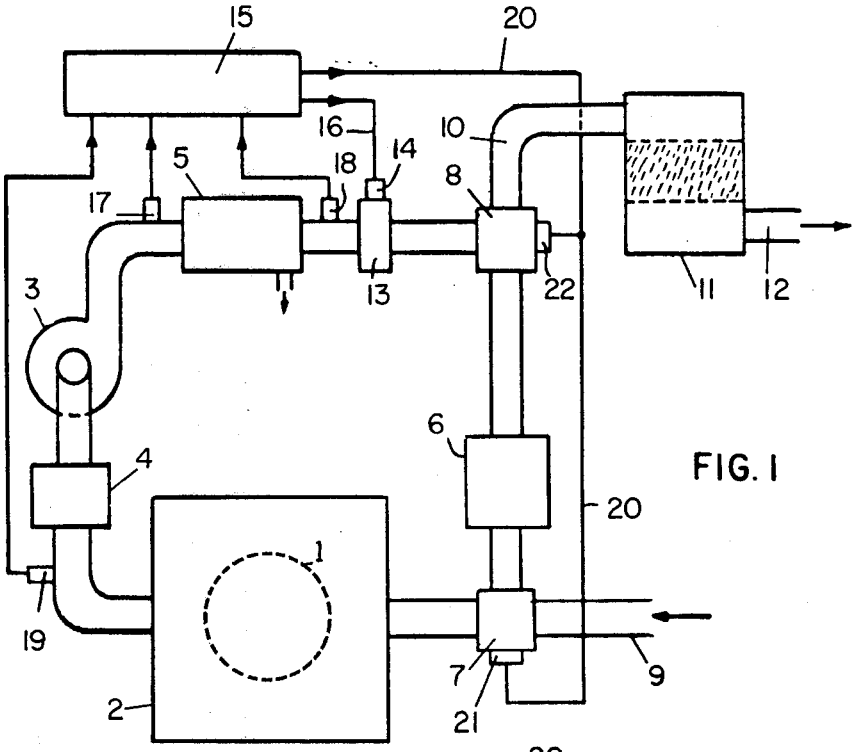
Figure 2:
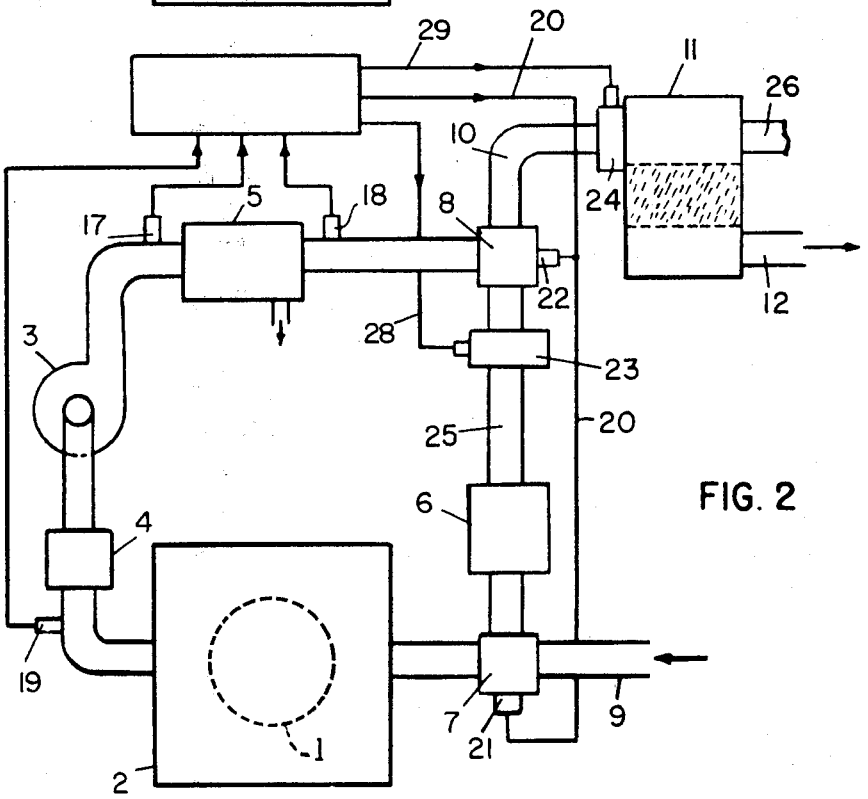
Figure 3:
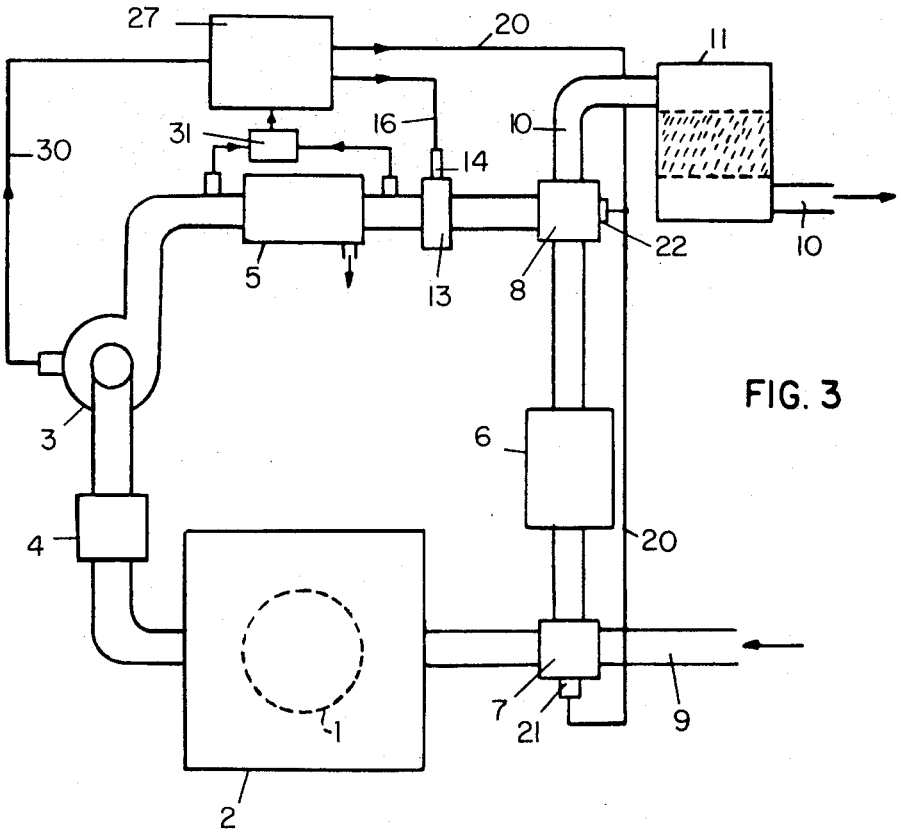
Figure 4:
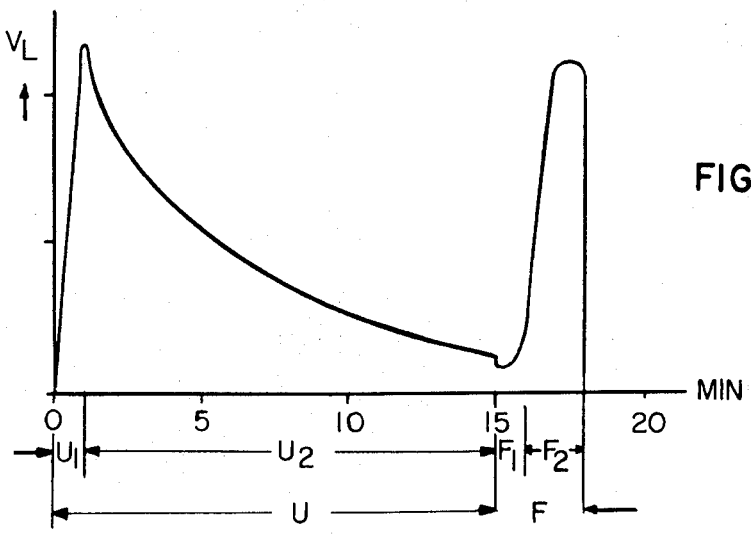

In order that the invention may be more readily understood, reference is made to the accompanying drawings which illustrate diagrammatically and by way of example a preferred embodiment thereof, and in which:

FIG. 1 is a diagrammatic view of a dry cleaning machine with connected adsorber and regulation of air volume by a throttle means within the common part of circulation-and fresh air way, FIG. 2 is an apparatus like that of FIG. 1, however, including separate means for throttling of the circulating air and the exhaust air, FIG. 3 is an apparatus like that of FIG. 1, however, with regulation of air volume by a timer and FIG. 4 is a diagram for illustration of the operation of the apparatus of FIGS. 1 to 3.

During the cleaning process which takes place in advance to the process for drying and separation of the solvents the textiles to be cleaned are subjected within a rotating drum or basket 1 of the cleaning chamber 2 to the influence of a cleaning substance including a chemical means like, for instance, Perchlorethylene, named solvent in the following description. At the end of the cleaning period the textiles are separated by a centrifugal power and then are dried for separation of most of solvents. This drying process is performed in two succeeding processes, namely a circulating interval and an exhaust interval.

During the circulating interval drying air is driven within a cycle by a blower 3 from the cleaning chamber 2 via a lint trap or fibre catching device 4 and then pressed through a condenser 5 and a heater 6 back to the cleaning chamber 2. The circulating air which is heated up to, for instance, 60° within the heater 6 will heat the textiles within the drum 1 and will take away solvents form the textiles. The air with increased concentration of solvents then will be cooled within condenser 5 by cooling water down to an outlet temperature of preferably smaller then 30° C. Almost all solvents at the entrance of condenser 5 exceeding the volume corresponding to the saturation temperature at the outlet of the condenser will be condensed and be separated as a liquid over a water separator to a tank of the cleaning machine.

After a certain interval the length of which is dependent on the character of the textiles the outer parts of the textiles will be dried. In the following interval the drying process will run more slowly because the solvent molecules have to travel a longer way of diffusion in order to be taken by the circulating air. Therefore, the concentration of the circulating air will diminish and also the volume of condensed solvents within the cooler. In other words, only immediately at the beginning of the drying process when the textiles or other goods to be cleaned have reached the desired high temperature the circulating air may reach for a short period the preferred saturation concentration corresponding to the temperature of the air when leaving the textiles. Only during this very short period a high quantity of solvents is separated within the condenser which portion will rapidly diminish. This may be observed within the show window between condenser and water separator or within the duct from the condenser to the water separator. At the end of the drying process there are only few drops which may be separated from the circulating air. Therefore, it is in such case not advisable to continue the drying process because the expenditure of energy does not justify a continuation of the drying process under these circumstances. At this time the concentration at the inlet and outlet of the condenser will approximate one another, if for instance the condenser will give a cooling of the circulating air from 60° C. to 35° C. the circulating air at the outlet of the condenser will leave the condenser with a saturation concentration of about 300 g Perchlorethylen and it will take over solvents from the surface of the textiles in spite of heating up to 60° C. only in such a small degree that the concentration at the inlet of the condenser will increase only very little above 300 g/m$^3$. Therefore, the drying process during the circulating period must be interrupted or finished as soon as the condensation within the condenser 5 practically has seized.

The solvents which remain after interruption of the circulating drying process must be removed or separated by fresh air. This is performed by changing over from circulating interval to fresh air interval.

By help of a switch for fresh air 7 valve for exhaust air 8 this change over to fresh air drying is operated. Doing this the heater 6 is switched out and fresh air is drawn through a duct 9 for fresh air by the blower 3 through the cleaning chamber 2 and lint trap 4 and is driven through condenser 5 and exhaust duct 10 to the adsorber 11, in which the remaining solvents are adsorbed so that highly cleaned air may leave the condenser through exhaust duct 12.

Within the common part of the circulating way and fresh air way there is provided a throttle device 13 between condenser 5 and exhaust valve 8. This throttle device may be adjusted by hand. In the embodiment of the drawing a regulating member 14 is provided which is operated via a control line 16 by an output signal of a calculator 15 inputs of which are connected to separate gauges for measuring of the condition values within the circulating air stream and fresh air stream. Such gauges 17 and 18 are shown for measurement of concentration at the inlet and outlet of condenser 5 and an additional guage 19 for the measurement of the output temperature at the cleaning chamber 2.

The calculator 15 may be programmed such that the operation is performed with maximum air volume without throttling the beginning and until the difference of the concentration between inlet and outlet of the condenser will decrease down to a given minimum. Subsequently the air volume will be diminished by adjustment of the throttling device 13 down to, for instance, 1/12 of the volume at the beginning. At a given low level of concentration difference at the gauges 17 and 18 change over from circulating interval to fresh air interval takes place. For this purpose the calculator 15 may be connected via a special control line 20 to regulating members 21 and 22 of change over switches 7 and 8. By this measurement an essential improvement of the drying process and a reduction of expenditure of energy is reached. Preferably the volume of circulating air and its temperatures may be adapted to the procedure of the drying process by corresponding adjustments. By reductions of the air volume circulation at the end of the circulation period the contact time between textiles and circulating air is increased. The degree of exchange increases in spite of diminished stream velocity on account of the constant contact surface between textiles and streaming air. Consequently, the concentration will increase compared with the concentration at the hitherto used constant velocity of air stream.

Within condenser 5 the circulating air will be cooled to a higher degree on account of the decreased velocity and solvents will be condensed according to this lower outlet temperature.

The decrease of air volume will be followed by a decrease of partial pressure of the solvents within the circulating air at the inlet of cleaning chamber 2 and with an increase of evaporation.

If beginning the fresh air drying process with an air volume lower than done hitherto, then a portion of the solvents taken over by the fresh air may be condensed within the machine. In order to obtain such a condensation the amount of air is throttled also at the beginning of the fresh air drying period so that a mixed temperature and a mixture condition is reached according to a higher temperature and a higher concentration than at the outlet of the condenser. Then, solvents surmounting the saturation concentration at outlet temperature will condense within the condenser. At the beginning of the fresh air drying period, therefore, one will continue with lower air volume. This lower air volume may be adjusted by the calculator at throttle 13 in such a manner that the fresh air will be subjected to an increase of temperature up to 60° C. within the textiles which temperature may be measured by gauge 19. The fresh air, which is primarily throttled, will cool the warm textiles continuously and will shift the mixture condition more and more into the area in which no solvent is separated within condenser 5.

In order to finish or interrupt the drying and separation procedure within a period as short as possible and in order to take out the textiles highly inodorous from the drum 1 it is preferred to increase the air volume $V_L$ approximately to the value of the usual value during the fresh air drying procedure. The difference of concentration between inlet and outlet of the condenser 5 is observed. At a given minimum, throttling of the air stream is interrupted so that fresh air will stream through the textile and the condenser 5 to adsorber 11 in an increasing amount.

The air leaving the machine at the beginning of the fresh air drying process will contain solvents to a degree which will make possible an additional separation. However, the entire amount of solvent coming into the adsorber 11 will be smaller than in the hitherto known apparatus using a constant air volume and consequently the connected adsorber will have a longer operation period because it can take over more charges. In the embodiment of FIG. 2 separate throttles 23 and 24 are provided for circulating air and fresh air. The throttle device for circulating air 23 is arranged within the duct between valve for air discharge 8 and valve for fresh air 7 in which duct is arranged also the heater 6. This portion of duct 25 is disconnected at change over from circulating period to fresh air period and the control of air volume will be taken over by throttle 24 which is controlled through control line 29. This throttle device 24 simultaneously represents the inlet for the exhaust air of adsorber 11. The adsorber thereby is provided with separated air inlets, namely the throttling exhaust air inlet 24 and a fresh air inlet 26 for regeneration of the active charcoal.

In the embodiment of FIG. 3 a timer 27 is provided for control of throttle 13 as well as valves 7 and 8. This timer is started by blower 3 via a starting line 30. This timer may be programmed in such a manner that it will control for the normal case the air volume in the desired optimal way in adaptation to the circumstances and especially to the dimension of the cleaning machine and adsorber.

The difference of concentration at the entrance and outlet of condenser 5 may be measured by a difference unit 31 and may be utilized for control of timer 27 in order to adapt the operation to unnormal conditions of solvent separation in the condenser 5.

If for instance this difference will decrease below a given minimum at a moment in advance of the normal time for change over from circulating interval, to fresh air interval then this change over should be take place earlier than programmed within timer 27.

As may be seen from FIG. 4 in the normal case the air volume will be increased during a first circulating interval $U_1$ up to a maximum in order to reach a desired heating of the circulating air up to an output temperature of heating device 6 of, for instance, 60° C. Consequently the air volume will be diminished during a following circulating interval $U_2$ of, for instance, 14 minutes gradually down to a minimum. After change over at the end of said circulating interval U the air volume will during unchanged adjustment of throttle 13 decrease on account of the additional flow resistance within the adsorber 11 as is illustrated in FIG. 4. The fresh air will then be heated up to approximately 60° C. within a first fresh air interval $F_1$ so that condenser 5 at the beginning of this interval $F_1$ will operate with essentially unchanged conditions or conditions like that at the end of cirulating interval $U_2$. If the adsorber 11 is provided with a separate blower it is possible to avoid the sudden decrease of air volume at change over from circulating operation to fresh air operation and may even be changed to a little stepwise increase of the air volume. Very soon after the beginning of the fresh air interval F the entrance temperature of condenser 5 will decrease from the beginning temperature of 60° C. and will move against the outlet temperature of 25° to 30° C. As soon as this occurs change over to full fresh air volume is performed within the adjoining fresh air interval $F_2$, so that adsorber 11 will perform the separation of the remaining sovlent. After a total drying time of approximately 18 minutes the separation of solvents from the whole system is finished. Even during the last portion of the fresh air drying process the cleaning machine is opened and the textiles may be taken out and new textiles to be cleaned may be brought in. The blower 3 then is switched out and the next cleaning process may follow.

By throttling the air stream at the beginning of the fresh air interval the separation process by condensation in condenser 5 is increased and adsorber 11 may be operated for a longer time in cleaning circuits.

The heating of the circulating air within heater 6 is controlled preferably in such a manner that in spite of change of air volume heating is performed up to a given temperature of, for instance, 60° C. Furthermore, the amount of cooling water within condenser 5 is controlled in such a manner that an essentially constant outlet temperature of, for instance, 30° C. is maintained.

It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. In a method for recovery of solvents from the circulating air and exhaust air of a dry cleaning machine (CRM) by drying of circulating air and by fresh air drying by help of condensation and adsorption, the improvement of changing the air volume dependent on the condition values for condensation and adsorption of the solvents including establishing an initial air volume at the beginning of a circulating dry interval and diminishing the air volume during said circulating dry interval to about 1/10 of the initial volume and thereafter establishing a fresh air drying interval in which the air volume is established at substantially said initial volume.

2. Method as defined in claim 1, wherein the air volume during fresh air drying (F) following a first fresh air drying interval ($F_1$) is increased from a minimum.

3. Method as defined in claims 1 and further including exchanging heat with the air before entrance into the dry cleaning machine comprising the step that the heating energy and/or the cooling energy is diminished with decreasing air volume.

4. Method as defined in claims 1, wherein the air volume during a first fresh air drying interval ($F_1$) is adjusted in such a manner that the fresh air will be heated up to a temperature of approximately 60° C.

5. Method as defined in claim 1, wherein the air volume is changed by hand.

6. Method as defined in claim 1, wherein the air volume is changed automatically.

7. Method as defined in claim 1 wherein the air volume is changed dependent on time.

8. Method as defined in claim 1, the air volume is changed dependent on concentration of solvents in said cleaning machine.

9. Method as defined in claim 1, wherein the air volume is changed dependent on temperature.

10. Method according to claim 8 and further including condensation of solvents within a condensor receiving circulating air of the cleaning machine wherein the air volume is changed dependent on the difference of solvent concentration at the inlet and outlet of said condenser.

11. In a cleaning machine for recovering of solvents from the circulating air and exhaust air of a dry cleaning machine (CRM) by drying of circulating air and by fresh air drying by help of condensation and adsorption having a treating chamber for treating solvent laden articles, air circulating means for passing air into contact with such articles to vaporize the solvent, means for withdrawing the solvent-laden air and passing such to a condensing means, control means for varying the volume of circulating air, the apparatus improvement comprising a device for change of air volume, wherein said control means includes means for changing the volume of circulating air dependent on the condition values for condensation and adsorption of the solvents and including means for establishing an initial air volume at the beginning of a circulating dry interval of said air circulating means and diminishing the air volume during said circulating dry interval to about 1/10 of the initial volume and thereafter establishing a fresh air drying interval in which the air volume is established at substantially said initial volume, said cleaning machine including an exhaust line, said control means comprising separate means for change of air volume within the cleaning machine and said exhaust line of the cleaning machine.

12. The improvement as defined in claim 11 and further including an adsorber within the cleaning machine exhaust line and having an exhaust air inlet with a throttle means.

13. The improvement as defined in claim 12 wherein the adsorber includes an adjustable throttle inlet for loading and a fresh air inlet for regeneration of the adsorber.

14. The improvement as defined in claims 11, 12 or 13 wherein said device is controlled automatically.

15. The improvement as defined in claim 14 and further comprising gauges for sensing concentration and/or temperature for providing signals for control of the air volume.

16. The improvement as defined in claim 14 wherein said device includes a timer for control of the air volume.

17. The improvement as defined in claim 14 and further comprising a programmed calculator wherein the gauges are connected to said programmed calculator to produce signals for controlling the air volume.

* * * * *